US007412195B2

(12) United States Patent
Park et al.

(10) Patent No.: US 7,412,195 B2
(45) Date of Patent: Aug. 12, 2008

(54) IMAGE FORMING APPARATUS HAVING MEANS TO PREVENT IMAGE QUALITY DEGRADATION

(75) Inventors: Moon-bae Park, Suwon-si (KR); Myung-ho Kyung, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 317 days.

(21) Appl. No.: 11/272,480

(22) Filed: Nov. 14, 2005

(65) Prior Publication Data

US 2006/0147230 A1 Jul. 6, 2006

(30) Foreign Application Priority Data

Nov. 13, 2004 (KR) ..... 10-2004-0092792

(51) Int. Cl.
*G03G 15/01* (2006.01)

(52) U.S. Cl. ..... 399/302

(58) Field of Classification Search ..... 399/66, 399/297, 298, 302, 308
See application file for complete search history.

(56) References Cited

U.S. PATENT DOCUMENTS 6,160,978 A * 12/2000 Tsuruoka et al. ..... 399/302
6,816,178 B2 * 11/2004 Yamada et al. ..... 399/302
6,920,299 B2 * 7/2005 Shimura et al. ..... 399/302
6,980,760 B2 * 12/2005 Okamoto et al. ..... 399/302
6,980,761 B2 * 12/2005 Yamada ..... 399/302
7,123,870 B2 * 10/2006 Kyung et al. ..... 399/302

FOREIGN PATENT DOCUMENTS

| | | |
|---|---|---|
| JP | 07-334011 | 12/1995 |
| JP | 11-327322 | 11/1999 |
| JP | 2002-023509 | 1/2002 |
| JP | 2002-091185 | 3/2002 |
| JP | 2003-098844 | 4/2003 |
| JP | 2004-094178 | 3/2004 |
| KR | 1020040009168 | 1/2004 |

* cited by examiner

*Primary Examiner*—William J Royer
(74) *Attorney, Agent, or Firm*—Roylance, Abrams, Berdo & Goodman, L.L.P.

(57) ABSTRACT

An image forming apparatus includes a transfer belt onto which a toner image formed on an outer surface of a photosensitive medium is transferred. The transfer belt moves along a predetermined closed path while being supported by a plurality of rollers. A protection unit protects the transfer belt by being attached to at least one of an inner surface and an outer surface of a non-transferring region of the transfer belt. A control unit controls the transfer belt so that an overlapping part where the protection unit is attached to the transfer belt, and a seam part where two ends of the transfer belt are connected stops at a predetermined location after printing. The image forming apparatus substantially prevents partial loss of an image by preventing wrinkles in the transfer belt.

23 Claims, 10 Drawing Sheets

IMAGE FORMING APPARATUS HAVING MEANS TO PREVENT IMAGE QUALITY DEGRADATION

CROSS REFERENCE TO RELATED APPLICATION

This application claims the benefit under 35 U.S.C. § 119 (a) of Korean Patent Application No. 10-2004-0092792, filed on Nov. 13, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus that prevents degradation of image quality by a transfer belt.

2. Description of the Related Art

Generally, an electrophotographic image forming apparatus is a printing device that prints a black and white or a multicolor image onto a piece of paper by irradiating a photosensitive medium charged to a uniform potential with light to form an electrostatic latent image. The electrostatic latent image is developed with toner using a developing unit. The developed image is transferred and fixed onto the piece of paper.

A conventional electrophotographic image forming apparatus that prints color images includes an exposing unit that emits light corresponding to image information. The exposing unit scans a photosensitive medium to form an electrostatic latent image thereon. Four developing units develop four colors of toner image by supplying toners of cyan (C), magenta (M), yellow (Y), and black (K) color to the electrostatic latent image formed on an outer surface of the photosensitive medium. A transfer belt transfers the toner image from the photosensitive medium to a piece of paper.

FIG. 1 is a cross-sectional view of an intermediate transfer unit of a conventional image forming apparatus. FIG. 2 is a schematic drawing illustrating a failure to transfer a portion of a toner image formed on a transfer belt. FIG. 3 is a plan view of the transfer belt depicted in FIG. 2.

Referring to FIG. 1, the intermediate transfer unit includes a transfer belt 5, an intermediate transfer roller 14, a plurality of supporting rollers 11, 12, and 13, and a nip roller 15. The supporting rollers 11, 12, and 13 support and rotate the transfer belt 5 that is installed around them. The nip roller 15, also mounted inside the loop made by the transfer belt 5, maintains a predetermined nip a between a photosensitive medium and the transfer belt 5.

The transfer belt 5 is mounted to face the photosensitive medium in a span between the intermediate transfer roller 14 and the nip roller 15 so that the toner image developed on the outer surface of the photosensitive medium can be transferred to the transfer belt 5. A transferring bias voltage for transferring the toner image formed on the photosensitive medium to the transfer belt 5 is applied to the intermediate transfer roller 14.

Referring to FIGS. 2 and 3, a protection unit 20 formed to a predetermined thickness is attached to inner and outer surfaces of the transfer belt 5 to protect the transfer belt 5 from damage. When the protection unit 20 is attached to the transfer belt 5, as depicted in FIG. 2, there is an overlapping part 40 where the transfer belt 5 and the protection unit 20 overlap, or a seam part 30 where the transfer belt 5 and the protection unit 20 are joined.

When the seam part 30 is located at a position where a high degree of stress is applied when the image forming apparatus is not in operation, a wrinkle may be formed due to different stretching rates of the transfer belt 5 and the protection unit 20. For example, as depicted in FIG. 2, if the seam part 30 of the transfer belt 5 is located at a supporting roller 11, 12, and 13, a wrinkle can be formed on a boundary face of the seam part 30 due to the different stretching rates. Also, when the overlapping part 40 is located at a position where tension is high, a localized deformation of the transfer belt 5 can occur by the concentration of stress on an edge part 42 that is thinner than other areas of the overlapping part 40, thereby forming a wrinkle on the transfer belt 5. The formation of wrinkles on the transfer belt 5 become more severe when the image forming apparatus is used in hot and humid environments.

When a new printing operation begins with the wrinkled transfer belt 5, a portion of a toner image may not be transferred from the photosensitive medium to the transfer belt 5 during the transfer process.

Although not shown in the drawings, when an electrostatic latent image formed on an outer surface of the photosensitive medium is developed by a developing unit, a strong vibration is generated on a developing roller at the moment a developing roller driving clutch of the developing unit is engaged or disengaged. The vibration is transmitted to the transfer belt 5 through the photosensitive medium. This vibration causes the formation of cross bands on the toner image being transferred from the photosensitive medium to the transfer belt 5.

Also, the toner image is vulnerable to scattering by an electrostatic force of the intermediate transfer roller 14 when transferring the toner image from the photosensitive medium to the transfer belt 5. This results in a blurry or scattered image on paper.

Also, during continuous printing, if the transfer belt 5 begins to wobble, image quality is further deteriorated.

Accordingly, a need exists for an image forming apparatus having an improved transfer belt to prevent poor image quality.

SUMMARY OF THE INVENTION

The present invention provides an image forming apparatus that prevents wrinkles at a seam part or an overlapping part of a transfer belt, and a protection unit attached to protect the transfer belt.

The present invention also provides an image forming apparatus that prevents transmission of vibrations to the transfer belt when a developing roller clutch is engaged or disengaged.

The present invention also provides an image forming apparatus that reduces scattering (blurring) of a toner image when transferring the toner image from a photosensitive medium to the transfer belt.

The present invention also provides an image forming apparatus whose size is reduced and that prevents the transfer belt from wobbling and meandering.

According to an aspect of the present invention, an image forming apparatus includes a transfer belt onto which a toner image formed on an outer surface of a photosensitive medium is transferred. The transfer belt travels along a predetermined closed path while being supported by a plurality of rollers. A protection unit protects the transfer belt by being attached to at least one of an inner surface and an outer surface of a non-transferring region of the transfer belt. A control unit controls the transfer belt so that an overlapping part where the protection unit is attached to the transfer belt, and a seam part where two ends of the transfer belt are connected stops at a predetermined location after a printing job.

Preferably, the control unit controls the transfer belt so that the overlapping part and the seam part stop at a span between rollers.

Preferably, the protection unit further includes a sensor unit that senses a stopping location of the transfer belt to stop at a predetermined location. The protection unit is installed parallel to the direction of movement of the transfer belt, near both edges of the transfer belt. The protection unit is attached to the transfer belt with a bonding tension force of less than 500 gf/mm (grams force per millimeter).

The rollers of the image forming apparatus include an intermediate transfer roller that transfers a toner image onto the transfer belt, a supporting roller that supports the transfer belt, and a nip roller that maintains a predetermined nip between the photosensitive medium and the transfer belt. A guide unit is installed at the inner surface of the transfer belt facing the photosensitive medium that maintains a predetermined nip between the photosensitive medium and the transfer belt.

Preferably, the guide unit is mounted close to the nip, and is electrically conductive. Preferably, the guide unit has a resistance of 0.1-3 MΩ, a hardness of 26-38°, and is mounted between the intermediate transfer roller and the nip roller.

The image forming apparatus may further include a bias preventing guide unit that extends in the direction of motion of the transfer belt, and is mounted on the protection unit attached to an inner surface of the transfer belt.

A guide pulley unit includes a guide groove, which regulates the movement of the bias preventing guide unit in a width direction. The guide pulley unit is preferably mounted on an outer surface of at least one of the rollers.

Preferably, the bias preventing guide unit and the guide pulley unit are mounted at a side of the transfer belt. The transfer belt is regulated by the guide pulley unit to not deviate from an outer surface of the guide pulley unit. The bias preventing guide unit preferably has a thickness greater than 0.8 mm and less than 1.2 mm.

An image forming apparatus includes a transfer belt onto which a toner image formed on an outer surface of a photosensitive medium is transferred. The transfer belt travels along a predetermined closed path while being supported by a plurality of rollers. Two rollers among the plurality of rollers are installed at an inner surface of the transfer belt so that a nip between the photosensitive medium and the transfer belt is maintained. A guide unit is installed at the inner surface of the transfer belt facing the photosensitive medium to prevent vibration of the nip during a transfer operation.

Preferably, the guide unit is mounted close to the nip. Preferably, the guide unit has electrical conductivity. Preferably, the guide unit is mounted between two rollers.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

The present invention will now be described more fully with reference to the accompanying drawings, in which exemplary embodiments of the invention are shown.

Figure 1:
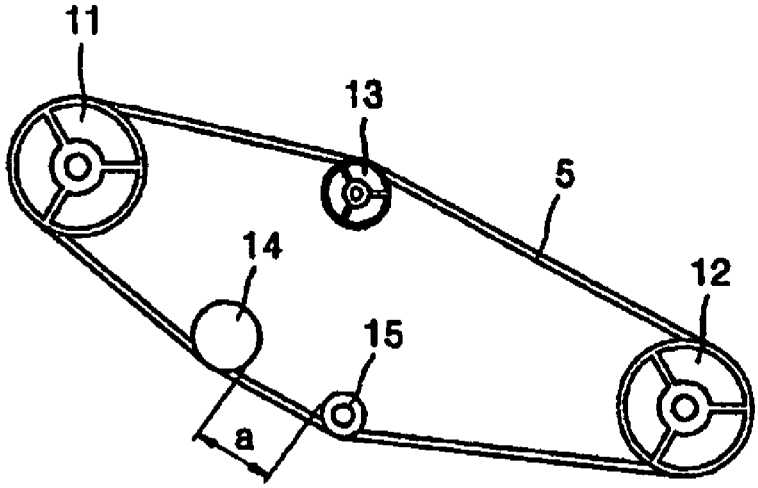
FIG. 1 (PRIOR ART)
FIG. 1 is a schematic view of an intermediate transfer unit of a conventional image forming apparatus.
Figure 2:
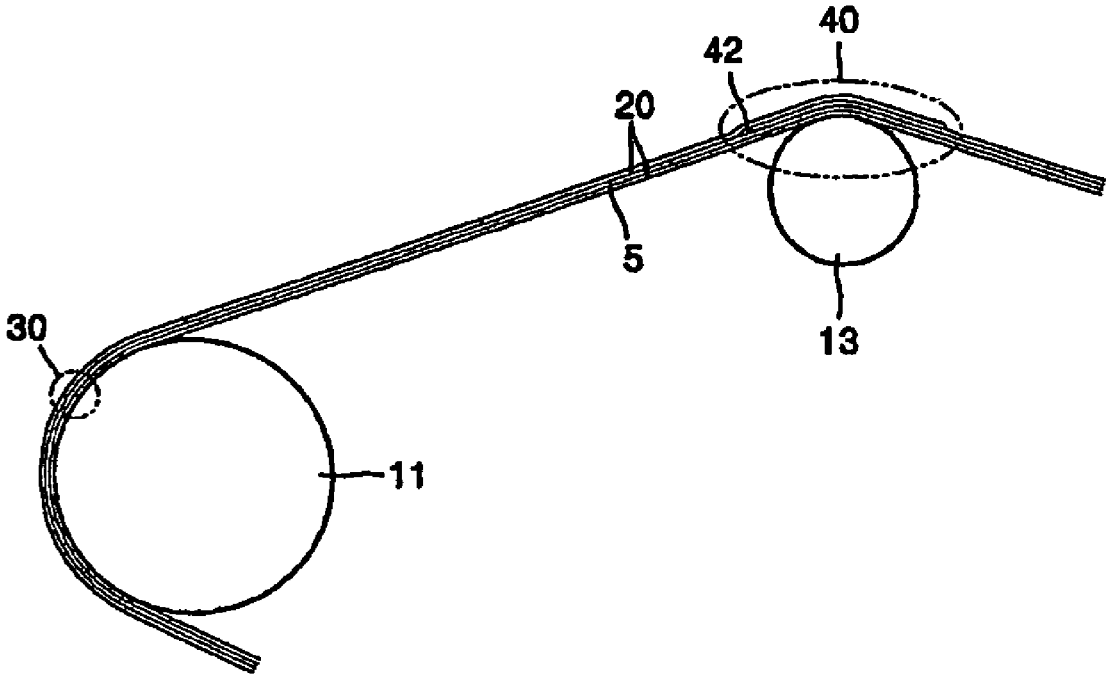
FIG. 2 (PRIOR ART)
FIG. 2 is a schematic drawing illustrating a failure to transfer a portion of a toner image formed on a transfer belt.
Figure 3:
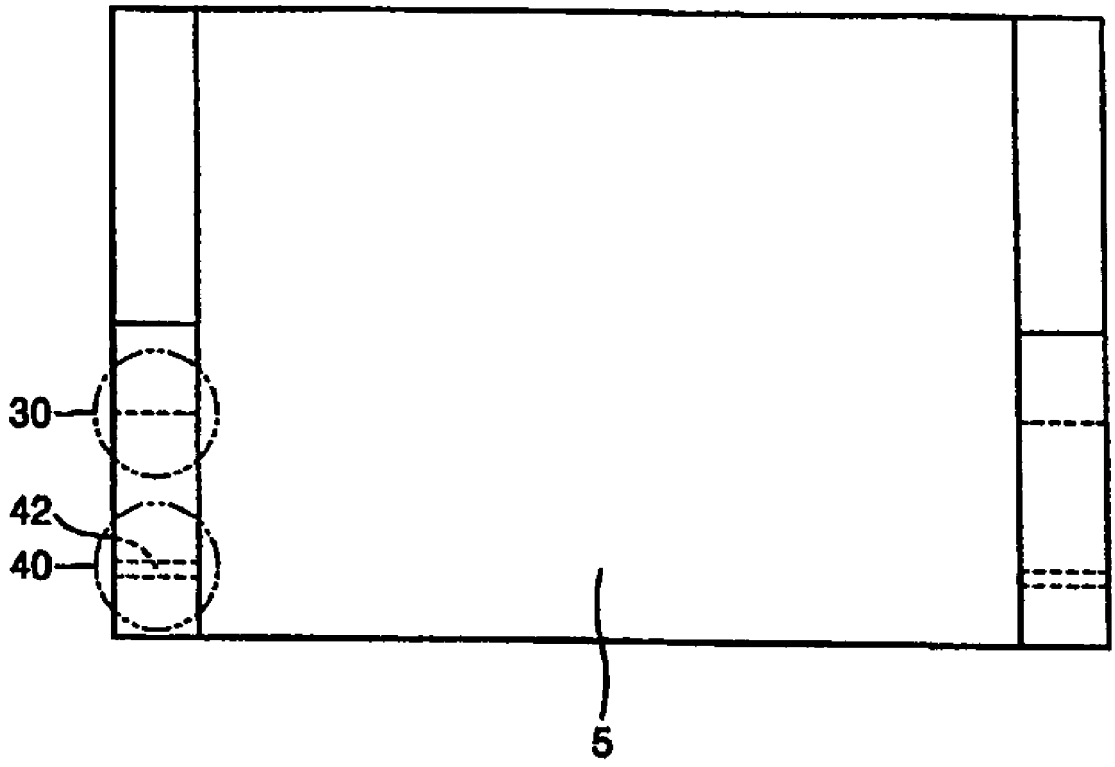
FIG. 3 (PRIOR ART)
FIG. 3 is a top plan view of the transfer belt depicted in FIG. 2.
Figure 4:
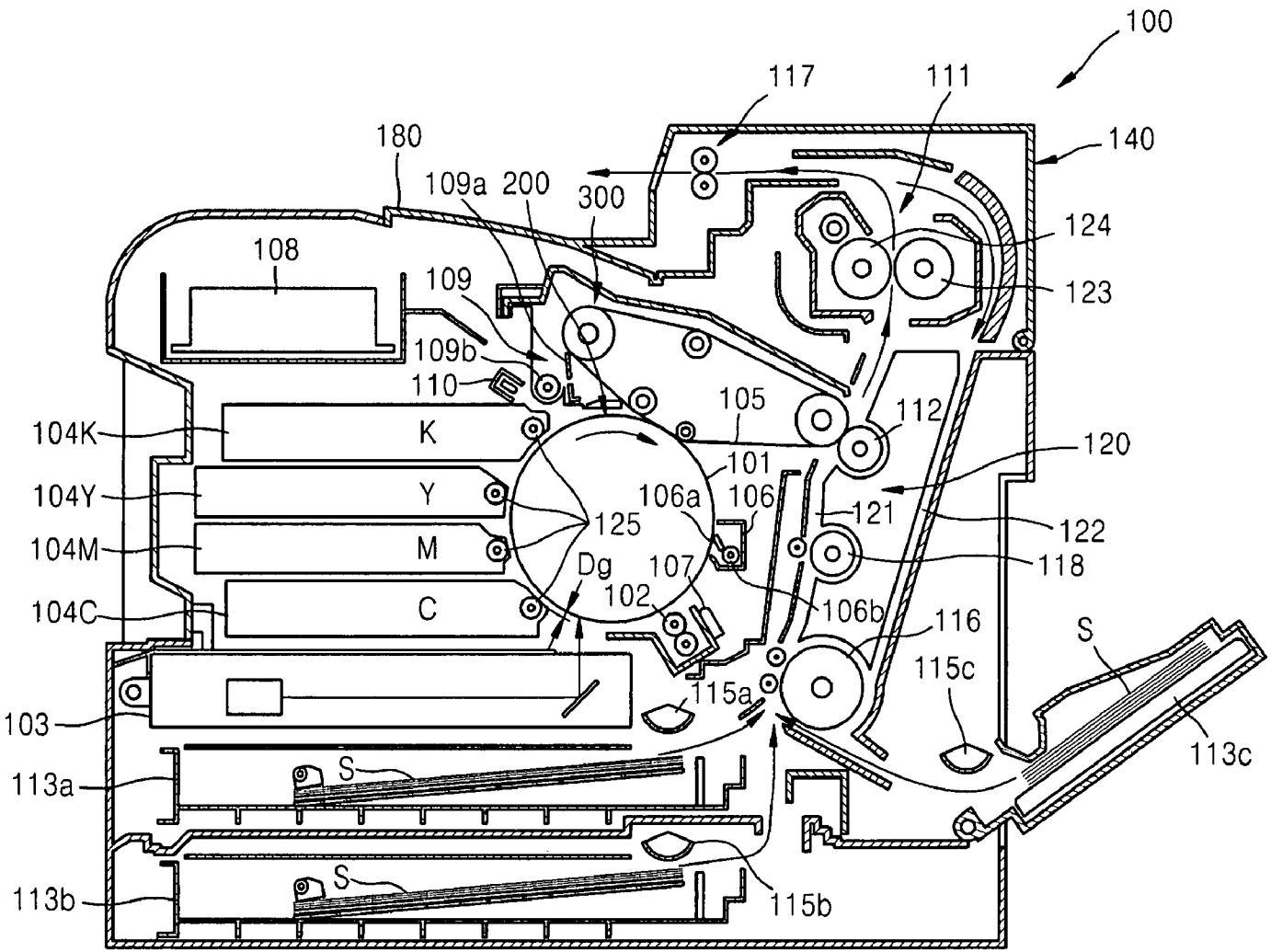
FIG. 4 is a schematic elevational view of an image forming apparatus according to an exemplary embodiment of the present invention.
Figure 5:
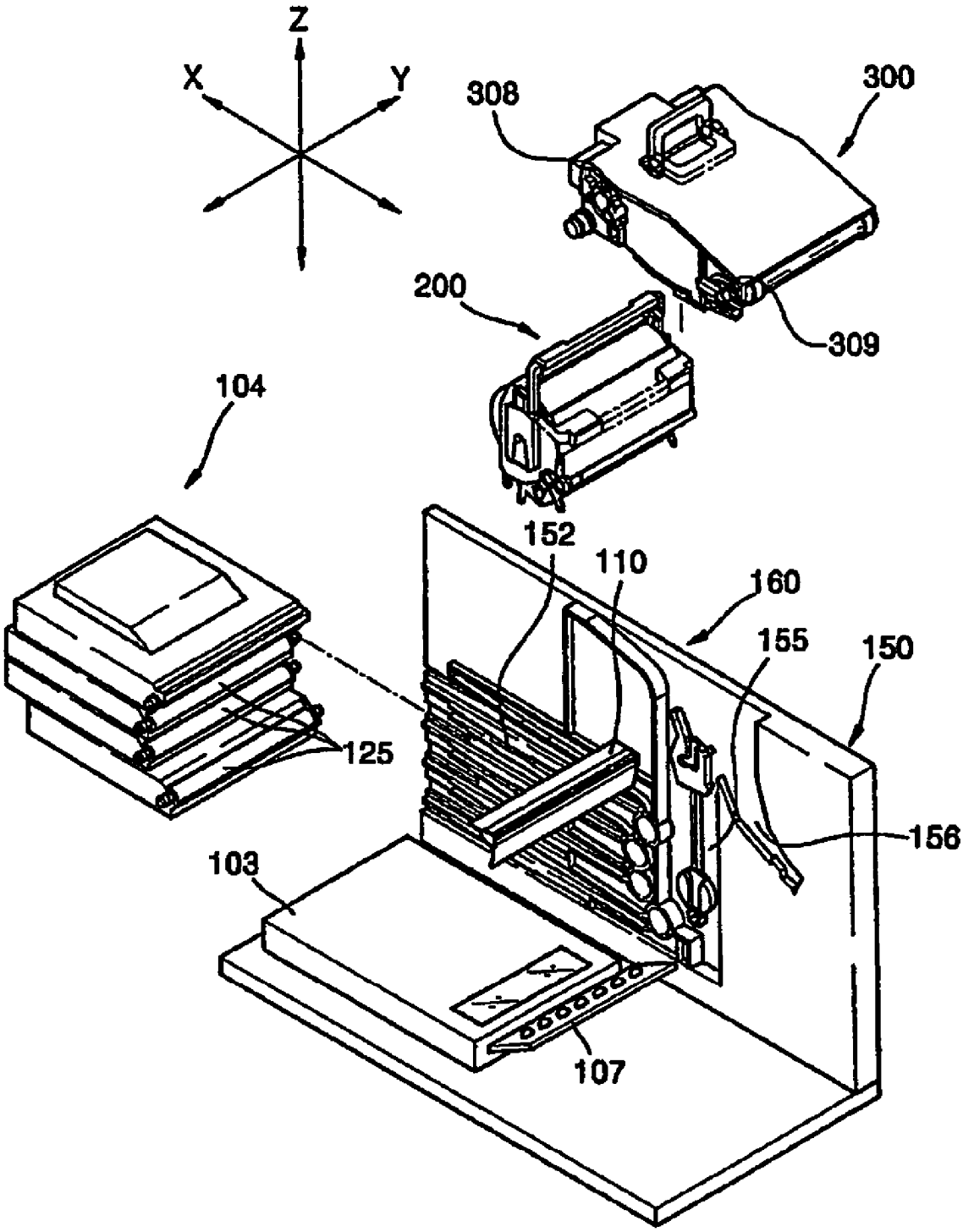
FIG. 5 is an exploded perspective view of the image forming apparatus of FIG. 4.
Figure 6:
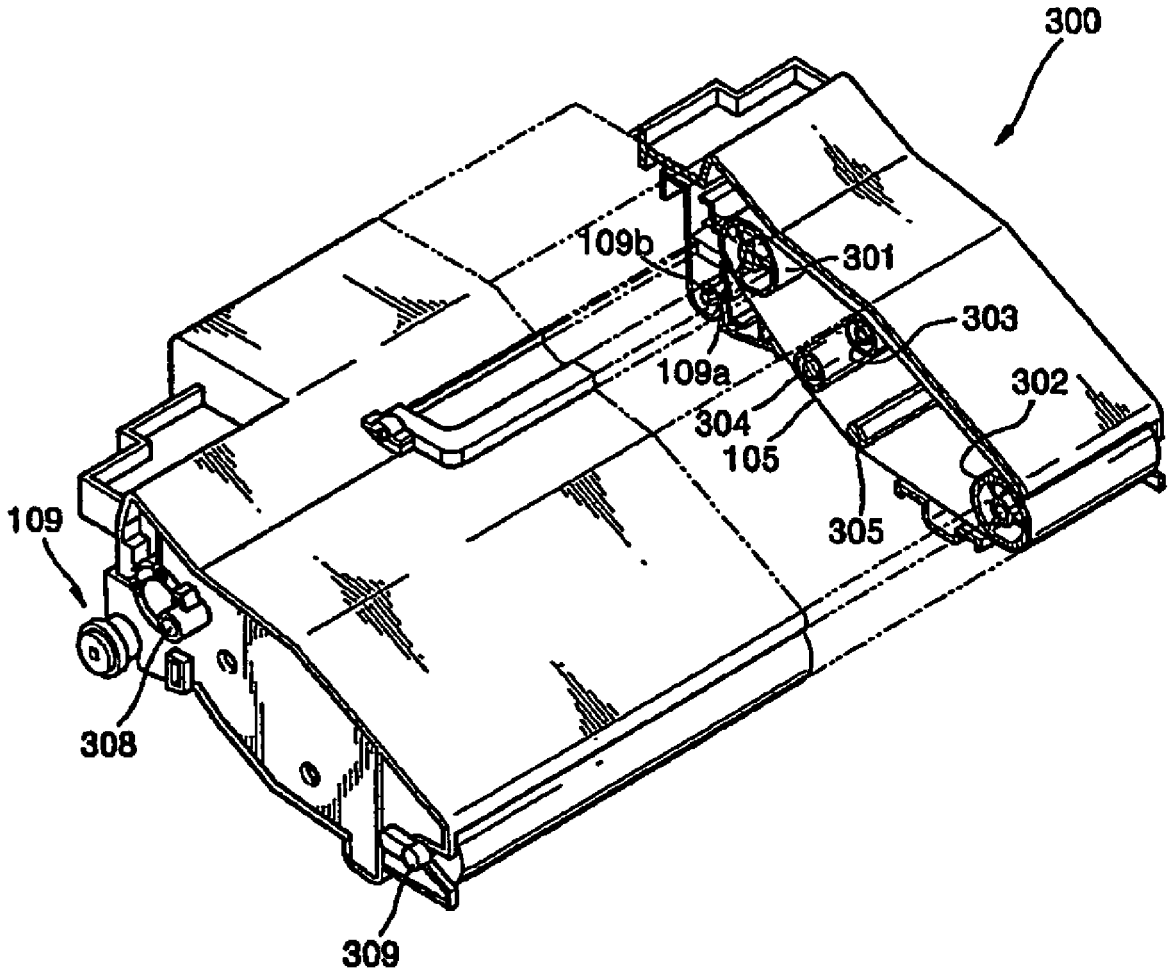
FIG. 6 is a perspective view of an intermediate transfer unit of FIG. 4.
Figure 7:
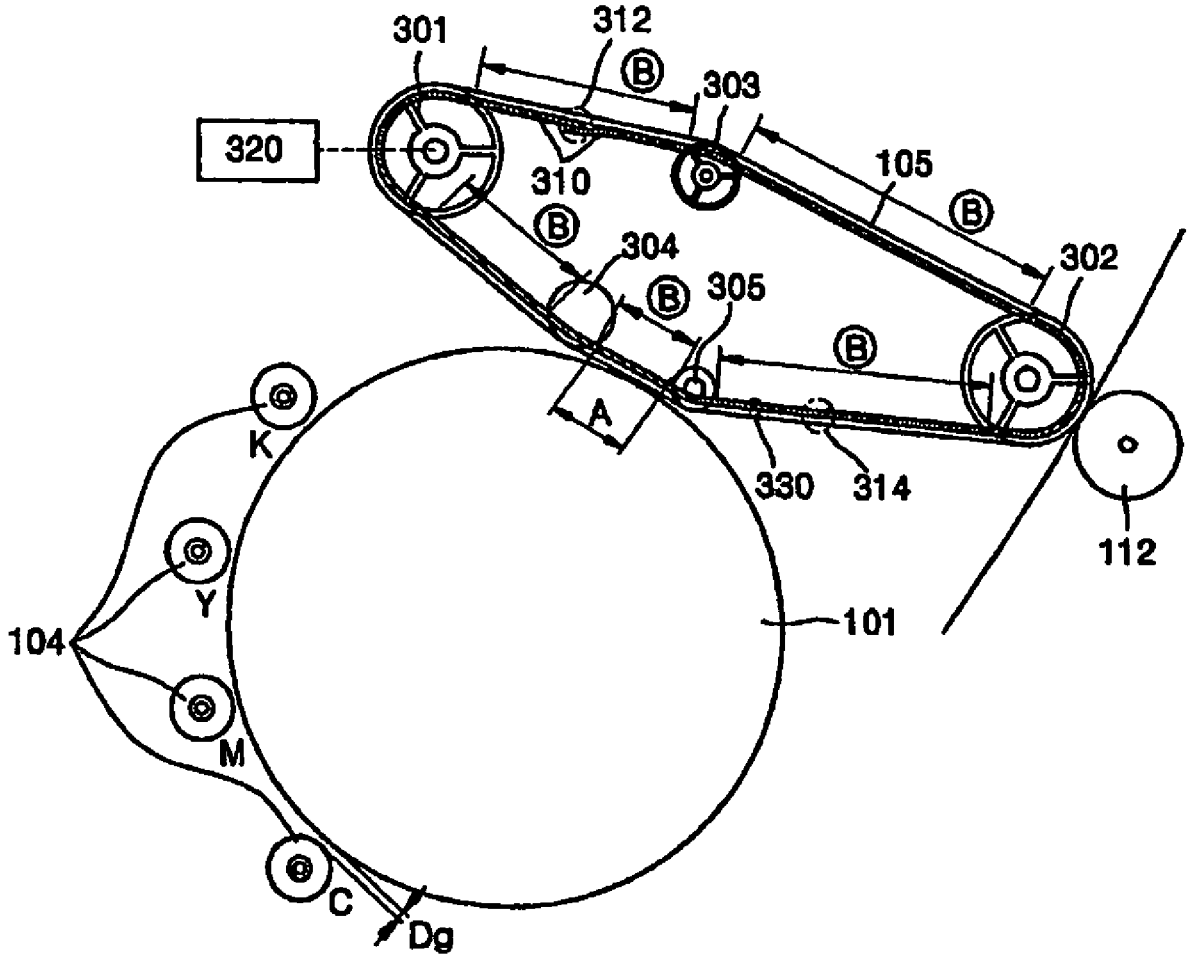
FIG. 7 is an elevational view of the intermediate transfer unit of FIG. 6.
Figure 8:
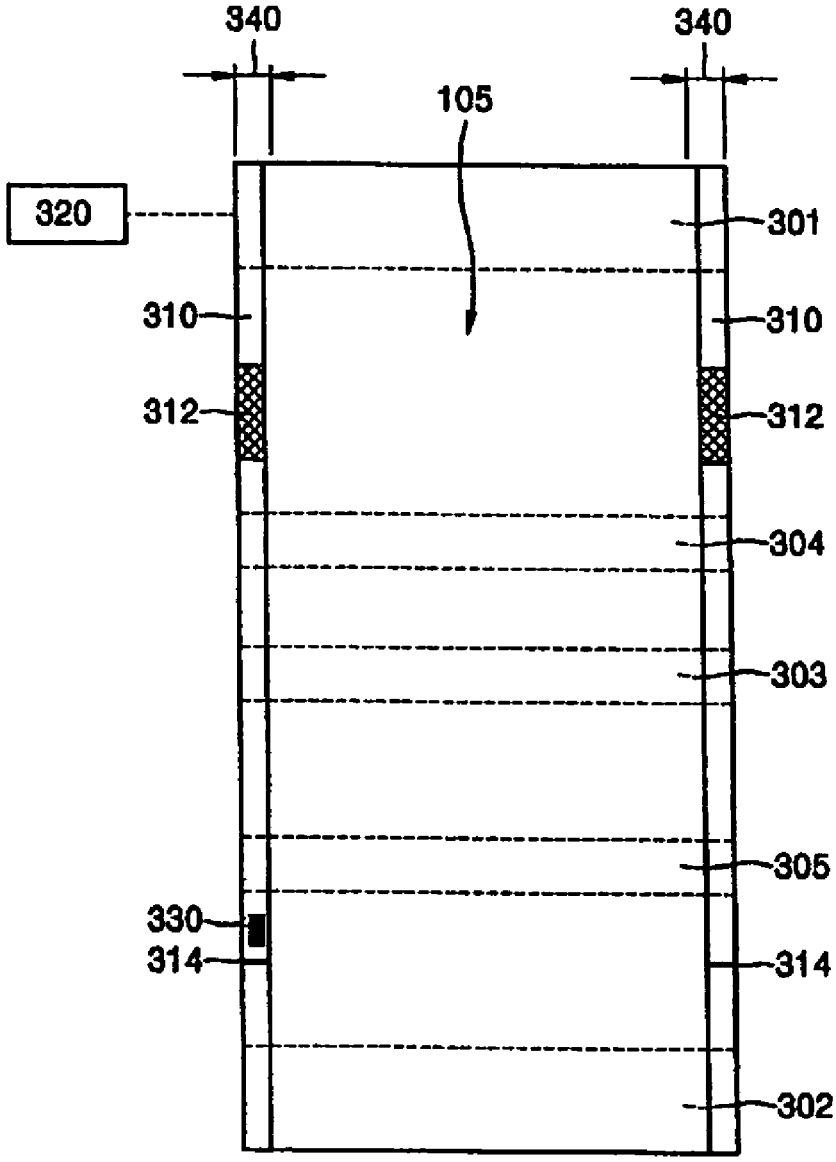
FIG. 8 is a top plan view of a transfer belt of FIG. 7.
Figure 9:
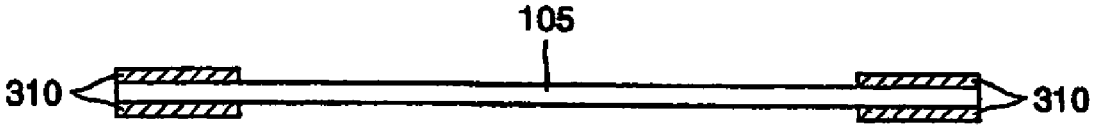
FIG. 9 is an elevational view in cross section of an intermediate transfer unit.

FIG. 4 is a schematic elevational view of an image forming apparatus according to an exemplary embodiment of the present invention. FIG. 5 is an exploded perspective view of the image forming apparatus of FIG. 4. FIG. 6 is a perspective view of an intermediate transfer unit of the image forming apparatus of FIG. 4. FIG. 7 is a schematic elevational view of the intermediate transfer unit of FIG. 6. FIG. 8 is a top plan view of a transfer belt of FIG. 7. FIG. 9 is an elevational view in cross section of an intermediate transfer unit.

Referring to FIG. 4, an image forming apparatus 100 includes a frame 140 that houses a photosensitive medium 101, a charge roller 102, a light scanning unit 103, four developing units 104, and a transfer belt 105.

The photosensitive medium 101 is a cylindrical metal drum whose outer surface is coated with a light conductive material layer using a deposition method. The photosensitive medium 101 rotates in a predetermined direction and an electrostatic latent image corresponding to an image to be printed is formed on the outer surface of the photosensitive medium 101 by a light radiated from the light scanning unit 103, which is described later.

The charge roller 102 is an example of a charger that charges the photosensitive medium 101 to a uniform potential. The charge roller 102 charges the outer surface of the photosensitive medium 101 to a uniform potential by rotating while in or out of contact with the outer surface of the photosensitive medium 101. A charge bias for charging the outer surface of the photosensitive medium 101 to a uniform potential is applied to the charge roller 102. A corona discharger (not shown) may be employed instead of the charge roller 102.

The light scanning unit 103 is mounted below the photosensitive medium 101 and forms an electrostatic latent image on an outer surface of the photosensitive medium 101, which is charged to a uniform potential by scanning the outer surface of the photosensitive medium 101 with light corresponding to image information. The light scanning unit 103 includes a light source (not shown) that radiates a laser beam and a beam deflector that deflects the laser beam radiated from the light source. A polygonal mirror (not shown) that scans with light by being rotated by a driving source may be employed as the beam deflector. A hologram disk (not shown) that uses a hologram pattern formed on a disk surface to deflect light and scan may be employed instead of the polygon mirror. A laser scanning unit (LSU) that uses a laser diode as the light source is preferably used as the light scanning unit 103.

The four developing units 104C, 104M, 104Y, and 104K are formed as removable cartridges and are mounted in the frame 140. Solid powder toners of cyan (C), magenta (M), yellow (Y), and black (K) color are contained in each of the developing units 104. Each of the four developing units 104C, 104M, 104Y, and 104K includes a developing roller 125 that forms a toner image by supplying toners to an electrostatic latent image formed on an outer surface of the photosensitive medium 101. The developing units 104C, 104M, 104Y, and 104K are replaced when the toner contained in the developing units 104C, 104M, 104Y, and 104K is exhausted.

A developing roller 125 supplies the toner accommodated in the developing units to the photosensitive medium 101 by causing the toner to adhere to the outer surface of the developing roller 125. The developing roller 125 accommodates a solid powder toner and develops a toner image by supplying the solid powder toner to an electrostatic latent image formed on the photosensitive medium 101. A developing bias for supplying the toner to the photosensitive medium 101 is applied to the developing roller 125.

The four developing units 104C, 104M, 104Y, and 104K are mounted with a predetermined developing gap Dg between themselves and the outer surface of the photosensitive medium 101. A toner transferring force from the photosensitive medium 101 to the developing roller 125 is generated by an electric field, and the charged toners are transferred by a reciprocal vibrational movement in a developing region formed within the developing gap Dg. The developing gap Dg is preferably tens to hundreds of microns.

Toner images of cyan (C), magenta (M), yellow (Y), and black (K) color sequentially formed on the photosensitive medium 101 are transferred onto the transfer belt 105. A color toner image is formed by repeatedly transferring the toner images onto the transfer belt 105. Generally, the length of the transfer belt 105 must be equal to or greater than the length of a piece of paper S on which the color toner image is finally formed.

An intermediate transfer unit 300 that includes a photosensitive medium unit 200 and the transfer belt 105 will now be described.

Referring to FIG. 5, a photosensitive medium unit 200 includes a photosensitive medium 101, an intermediate transfer unit 300 that includes a transfer belt 105, and four developing units 104C, 104M, 104Y, and 104K, each of which include a developing roller 125, is mounted in a main frame 150 of the frame 140 (see FIG. 4).

The photosensitive medium unit 200 is mounted to be vertically detachable. The intermediate transfer unit 300 is mounted above the photosensitive medium unit 200 and is also vertically detachable. The four developing units 104C, 104M, 104Y, and 104K are mounted to be horizontally detachable by sliding in a direction X from a side of the photosensitive medium 101. A locking device 160 fixes the photosensitive medium unit 200 and the intermediate transfer unit 300 in the frame 140, and guide paths 152, 155, and 156 guide the photosensitive medium unit 200 and the intermediate transfer unit 300 to the fixing position, both of which are mounted in the main frame 150. Although not shown in FIG. 5, another locking device 160 is provided between the photosensitive medium unit 200 and the intermediate transfer unit 300.

In an exemplary embodiment of the present invention, a cyan developing unit 104C, a magenta developing unit 104M, a yellow developing unit 104Y, and a black developing unit 104K are sequentially disposed in the upward direction. A pre-transfer eraser 110 is disposed above the black developing unit 104K. The light scanning unit 103 and an erasing lamp 107 are disposed below the photosensitive medium unit 200. Although not shown in FIG. 5, a paper conveying unit 120 (see FIG. 4) is mounted on an opposite side of the developing units 104C, 104M, 104Y, and 104K with respect to the photosensitive medium unit 200.

Referring to FIG. 6, the intermediate transfer unit 300 includes the transfer belt 105, an intermediate transfer roller 304, a plurality of supporting rollers 301, 302, and 303, a nip roller 305, and a second cleaning device 109.

The supporting rollers 301, 302, and 303 are installed inside the surface of the transfer belt 105 and support and rotate the transfer belt 105 in a predetermined direction. The supporting roller 301 is preferably a driving roller. The supporting roller 302 disposed opposite the supporting roller 301 faces a transferring roller 112, as shown in FIG. 7.

A first supporting unit 308 and a second supporting unit 309 are included at both sides of the intermediate transfer unit 300. The first supporting unit 308 and the second supporting unit 309 are inserted in the guide paths 155 and 156 (see FIG. 5). The first supporting unit 308 is disposed close to the supporting roller 301, and the second supporting unit 309 is disposed close to the supporting roller 302.

Referring to FIG. 7, a nip roller 305 installed inside the surface of the transfer belt 105 maintains a predetermined nip A between the photosensitive medium 101 and the transfer belt 105. A first transferring bias voltage is applied to the intermediate transfer roller 304 so that a toner image formed on the photosensitive medium 101 may be transferred to the transfer belt 105.

The transfer belt 105 is mounted to face the photosensitive medium 101 in a span between the intermediate transfer roller 304 and the nip roller 305, so that the toner image formed on the outer surface of the photosensitive medium 101 may be transferred to the transfer belt 105. The transfer belt 105 is moved along a predetermined path by the supporting rollers 301, 302 and 303, and the toner images developed on the outer surface of the photosensitive medium 101 are transferred to the transfer belt 105. The transfer belt 105 may be a polyimide belt which has high charge capability that increases as the thickness of the transfer belt 105 decreases. In an exemplary embodiment of the present invention, a polyimide belt having a thickness of approximately 75 μm is preferably used as the transfer belt 105.

Referring to FIGS. 7 through 9, a protection unit 310 that protects the transfer belt 105 is attached to at least one side of the transfer belt 105 within a non-transferring region 340. In an exemplary embodiment of the present invention, a protection tape having a predetermined thickness is preferably used as the protection unit 310.

A control unit 320 is mounted on a main body of the image forming apparatus 100 and controls a stopping location of the transfer belt 105 after printing. Referring to FIG. 8, to prevent deformation of the transfer belt 105 due to stress, the control unit 320 controls the transfer belt 105 such that an overlapping part 312 where the protection unit 310 overlaps with the transfer belt 105, or a seam part 314 where the transfer belt 105 is connected, stops at a predetermined location after printing.

Referring to FIG. 7, the control unit 320 preferably controls the transfer belt 105 such that the overlapping part 312 and the seam part 314 stop at a span B between rollers. In this manner, image degradation caused by localized deformation of the transfer belt 105 when a printing process begins is prevented by locating the overlapping part 312 or the seam part 314 at a span where stress is not concentrated when the transfer belt 105 is stopped. The overlapping part 312 and the seam part 314 are preferably stopped at a location where little tension is applied to the transfer belt 105.

A sensor unit 330 for stopping the transfer belt 105 may also be included in the protection unit 310. In an exemplary embodiment, the sensor unit 330 is formed of a transparent material to facilitate stopping the transfer belt 105 at a predetermined location in connection with a light sensor (not shown) formed on the main body. However, in other exemplary embodiments of the present invention, a non-transparent material may be used for sensing.

The protection unit 310 for protecting the transfer belt 105 is preferably disposed parallel to the rotating direction of transfer belt 105, near both edges of the transfer belt 105.

Wrinkles may be generated on the transfer belt 105 due to the different stretching rate between the transfer belt 105 and the protection unit 310, or the concentration of stress in a hot and humid atmosphere. To substantially prevent wrinkles, the protection unit 310 is preferably attached to the transfer belt 105 with a bonding tension force of less than 500 gf/mm.

The transferring roller 112 is mounted to face a surface of the transfer belt 105 on which a toner image is transferred. A transferring bias voltage having an opposite polarity to the toner image is applied to the transferring roller 112 so that the toner image on the transfer belt 105 may be transferred to a piece of paper S (FIG. 4). The toner image is transferred to a piece of paper S by an electrostatic force acting between the transfer belt 105 and the transferring roller 112. The transferring roller 112 is separated from the transfer belt 105 while the toner image is transferred onto the transfer belt 105, and, when the toner image is completely transferred onto the transfer belt 105, the transferring roller 112 contacts the transfer belt 105 with a predetermined pressure to transfer the toner image onto the piece of paper S. The toner image transferred onto the outer surface of the transfer belt 105 may be printed onto the piece of paper S that passes between the transferring roller 112 and the transfer belt 105 by contact pressure between the transferring roller 112 and the transfer belt 105.

A first cleaning device 106 removes unused toner remaining on an outer surface of the photosensitive medium 101 after transferring a toner image onto the transfer belt 105, as shown in FIG. 4. The first cleaning device 106 includes a blade 106*a* that scrapes unused toner from the surface of the photosensitive medium 101, and a conveying means 106*b* that conveys the unused toner gathered by the blade 106*a* to a storage area (not shown). The conveying means 106*b* may be an auger that conveys the unused toner on a spiral wing rotating in a predetermined direction.

A second cleaning device 109 (FIGS. 4 and 6) removes remaining unused toner on the transfer belt 105 after the toner image is transferred onto a piece of paper S. The second cleaning device 109 includes a blade 109*a* that scrapes unused toner from the surface of the transfer belt 105, and a conveying means 109*b* that conveys the unused toner to an unused toner storage area (not shown). The conveying means 109*b* may be an auger that conveys the unused toner on a spiral wing rotating in a predetermined direction.

The pre-transfer eraser 110 removes charges on a non-image region where no toner image is formed prior to transferring the toner image from the photosensitive medium 101 to the transfer belt 105. The pre-transfer eraser 110 is installed to increase the efficiency of transferring the toner image from the photosensitive medium 101 to the transfer belt 105.

The erasing lamp 107 removes charges remaining on the outer surface of the photosensitive medium 101 in a pre-charge step. The erasing lamp 107 removes charges remaining on the surface of the photosensitive medium 101 by irradiating the surface of the photosensitive medium 101 with light of a predetermined intensity.

A high voltage power supply unit 108 supplies a developing bias voltage for transferring toner from the developing unit 104 to the photosensitive medium 101, a development preventing bias voltage for preventing the transfer of toner from the developing unit 104 to the photosensitive medium 101, a first transferring bias voltage for transferring a toner image from the photosensitive medium 101 to the transfer belt 105, a second transferring bias voltage for transferring a toner image from the transfer belt 105 to a piece of paper S, and a charge bias voltage supplied between the charge roller 102 and the components mounted in the image forming apparatus 100.

A fixing unit 111 includes a heat roller 123 and a press roller 124 installed facing the heat roller 123 that fixes a toner image onto a piece of paper S by applying heat and pressure to the toner image transferred onto the piece of paper S. The heat roller 123 is a heat source for permanently fixing the toner image and is installed facing the press roller 124 in an axial direction. The press roller 124 is installed facing the heat roller 123 and fixes the toner image onto the piece of paper S by applying a high pressure to the piece of paper S.

A paper discharge roller pair 117 discharges a piece of paper S on which an image is fixed to out of the image forming apparatus 100. The piece of paper S discharged from the image forming apparatus 100 is stacked on a paper deck 180.

Reference numeral 113*a* indicates a paper supply cassette as an example of a stacking means on which the paper S is stacked. The stacking means may include a second paper supply cassette 113*b* and a multi-purpose feeder (MPF) 113*c* that additionally stack paper. The MPF 113*c* is mainly used for feeding OHP (overhead projector) paper or paper of unspecified size.

A feed roller 116 conveys paper S withdrawn from a paper supply cassette 113*a*, 113*b*, and 113*c* by pickup rollers 115*a*, 115*b*, and 115*c* to the paper conveying unit 120.

The paper conveying unit 120 includes a paper path 121 that guides paper S between the feed roller 116 and fixing unit 111, and a duplex path 122 for dual-sided printing. A paper registration roller 118 is mounted on the paper conveying unit 120. The paper registration roller 118 registers paper S so that a toner image may be transferred onto a desired position of the paper S before passing between the transfer belt 105 and the transferring roller 112. The conveyed piece of paper S receives a toner image while passing between the transfer belt 105 and the transferring roller 112. The toner image transferred onto the piece of paper S is fixed thereto by the fixing unit 111 and discharged from the image forming apparatus 100 by the paper discharge roller pair 117.

The paper discharge roller pair 117 is rotated in reverse for dual-sided printing and the piece of paper S is conveyed along the duplex path 122. The paper S is reversed so that an image may be printed on a second surface on which no image has been printed. Then, an image is printed on the second surface of the reversed paper S while the paper S is conveyed through the paper path 121 by the feed roller 116.

The operation of the image forming apparatus according to an exemplary embodiment of the present invention will now be described in detail.

Color image information is a mixture of information corresponding to cyan (C), magenta (M), yellow (Y), and black (K) colors. In an exemplary embodiment, each toner image of cyan (C), magenta (M), yellow (Y), and black (K) colors is sequentially overlapped on the transfer belt 105. A color image is then formed by transferring and fixing the composite toner image from the transfer belt 105 onto a paper S.

An outer surface of the photosensitive medium 101 is charged to a uniform potential by the charge roller 102. When a light signal corresponding to image information of the cyan C color is radiated onto the rotating photosensitive medium 101 by the light scanning unit 103, charges adhering to an outer surface of the photosensitive medium 101 that is irradiated are reduced as resistance is reduced. Accordingly, a potential difference is generated between an irradiated part and a part that was not irradiated, and an electrostatic latent image is formed on the outer surface of the photosensitive medium 101 by the potential difference.

The developing roller 125 of the cyan developing unit 104C begins to rotate when an electrostatic latent image approaches the cyan developing unit 104C due to rotation of the photosensitive medium 101. A developing bias voltage is applied to the developing roller 125 of the cyan developing unit 104C from the high voltage power supply unit 108. However, a development preventing bias voltage that prevents developing is applied to the developing roller 125 of the rest of the developing units 104M, 104Y, and 104K. At this time, only the toner of cyan C color adheres to the electrostatic latent image formed on the outer surface of the photosensitive medium 101 across the developing gap Dg, thereby forming a toner image of cyan C color.

When the toner of cyan C color approaches the transfer belt 105 due to rotation of the photosensitive medium 101, the toner image is transferred onto the transfer belt 105 by a first transferring bias voltage or a contact pressure between the transfer belt 105 and the photosensitive medium 101.

When the toner of cyan C color is completely transferred onto the transfer belt 105, toners of magenta (M), yellow (Y), and black (K) color are sequentially transferred onto the transfer belt 105 through the same steps as described above for cyan (C) toner. At this time, the developing driving device drives the developing units 104C, 104M, 104Y, and 104K so that the developing may be performed through the aforementioned steps.

In the above process, the transferring roller 112 is separated from the transfer belt 105. When a color toner image is formed on the transfer belt 105 by sequentially transferring the toners of all four colors, the transferring roller 112 contacts the transfer belt 105 to transfer the color toner image to paper S.

A piece of paper S is supplied from the paper supply cassette 113*a* (or 113*b*) or the MPF 113*c* to the transfer belt 105 such that an end of the piece of paper S reaches a point where the transfer belt 105 and the transferring roller 112 are in contact at the same time as an end of the color toner image formed on the transfer belt 105 reaches a point where the transfer belt 105 contacts the transferring roller 112. Thus, the color toner image is transferred onto the piece of paper S by a second transferring bias voltage when the piece of paper S passes between the transfer belt 105 and the transferring roller 112. The color toner image transferred onto the piece of paper S is fixed onto the piece of paper S by heat and pressure in the fixing unit 111. The formation of a color image is then completed by discharging the piece of paper S through the paper discharge roller pair 117.

For subsequent printing, the first and second cleaning devices 106 and 109 respectively remove remaining unused toner from the photosensitive medium 101 and the transfer belt 105, and the erasing lamp 107 removes charge remaining on the photosensitive medium 101 by irradiating the photosensitive medium 101.

After a print job is completed, the control unit 320 controls the transfer belt 105 to stop the overlapping part 312 and the seam part 314 at a span portion B of the transfer belt 105 to substantially prevent wrinkles in the transfer belt 105 that may degrade image quality.

An image forming apparatus according to another exemplary embodiment of the present invention will now be described with reference to the accompanying drawings. In the drawings, components of the exemplary embodiment described below that are the same as in the exemplary embodiment described above are denoted by the same reference numerals.

Figure 10:
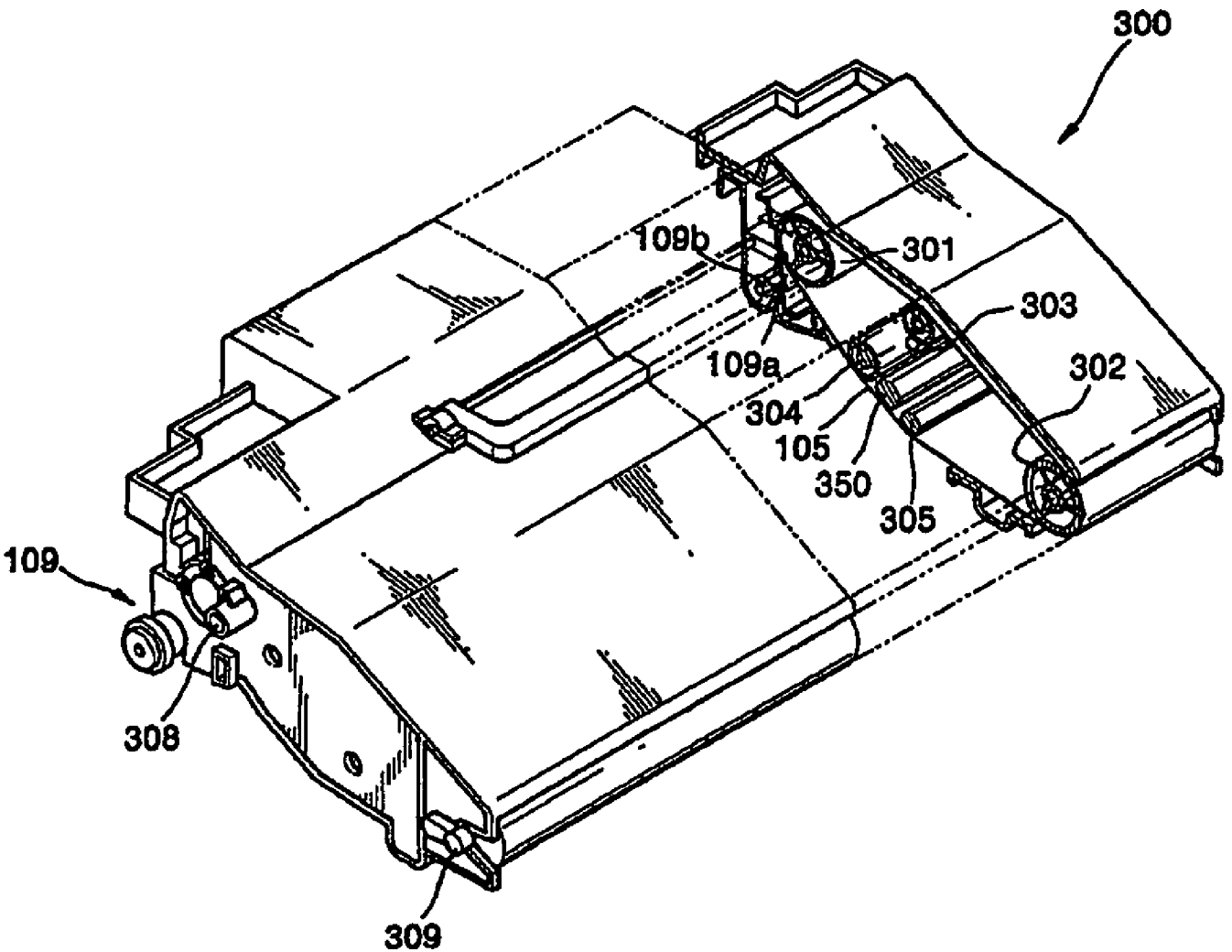
FIG. 10 is a perspective view illustrating an intermediate transfer unit according to another exemplary embodiment of the present invention.

FIG. 10 is a perspective view illustrating an intermediate transfer unit 300 according to another embodiment of the present invention.

The overall configuration and operation of the image forming apparatus, and the configuration and operation of the control unit that controls the stopping location of the transfer belt 105, are substantially similar to the exemplary embodiment described above.

Figure 11:
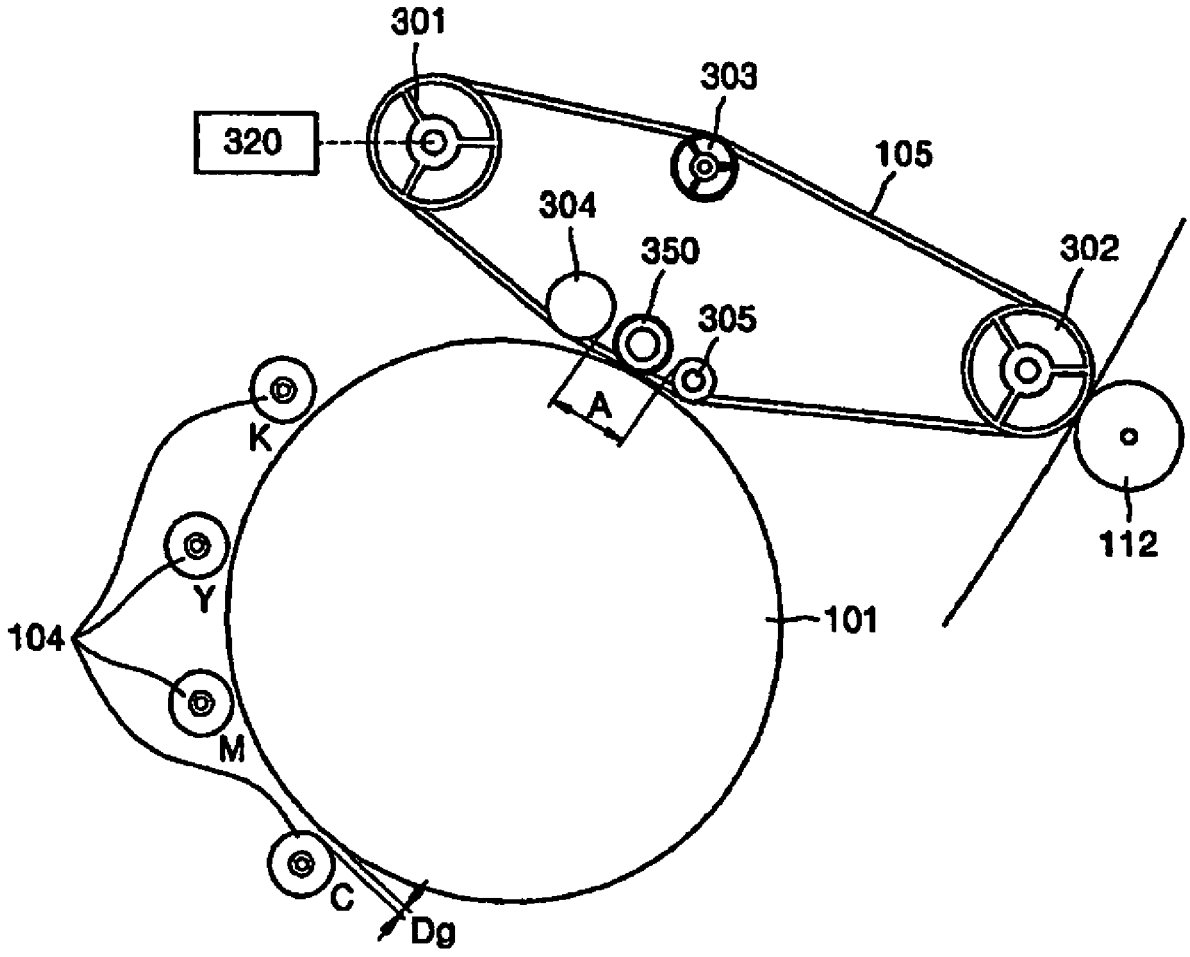
FIG. 11 is a schematic elevational view of a photosensitive medium unit and an intermediate transfer unit.

Referring to FIGS. 10 and 11, the intermediate transfer unit 300 includes a transfer belt 105, an intermediate transfer roller 304, a plurality of supporting rollers 301, 302, and 303, a nip roller 305, and a guide unit 350.

The supporting rollers 301, 302, and 303 are installed inside the surface of the transfer belt 105 and support and rotate the transfer belt 105 in a predetermined direction.

A nip roller 305 is also installed inside the surface of the transfer belt 105 and maintains a predetermined nip A between a photosensitive medium 101 and the transfer belt 105.

A first transferring bias voltage is applied to an intermediate transfer roller 304 for transferring a toner image formed on the photosensitive medium 101 to the transfer belt 105.

The transfer belt 105 is mounted to face the photosensitive medium 101 in a span between the intermediate transfer roller 304 and the nip roller 305 so that the toner image formed on an outer surface of the photosensitive medium 101 may be transferred onto the transfer belt 105. The transfer belt 105 may be a polyimide belt that has a high charge capability that increases as the thickness of the transfer belt 105 decreases. In an exemplary embodiment, a polyimide belt having a thickness of approximately 75 μm is preferably used as the transfer belt 105.

When printing a color image, toner images of cyan (C), magenta (M), yellow (Y), and black (K) color are sequentially developed on the photosensitive medium 101. When developing each color, a driving clutch (not shown) of a developing roller 125 of a corresponding developing unit 104 is engaged. The developing roller 125 generates strong vibrations when the clutch of the developing roller 125 of each of the developing units 104 is engaged while a toner image developed on an electrostatic latent image of the photosensitive medium 101 is transferred onto the transfer belt 105. This vibration is transmitted from the developing roller 125 to the photosensitive medium 101 and to the transfer belt 105. Therefore, the guide unit 350 is added for preventing cross bands, scattering, and blurring in a toner image being transferred from the photosensitive medium 101 to the transfer belt 105 due to the vibration.

The guide unit 350 is mounted inside the surface of the transfer belt 105 to face the photosensitive medium 101 to maintain the predetermined nip A between the photosensitive medium 101 and the transfer belt 105. The guide unit 350 is preferably a roller since the transfer belt 105 rotates in contact with an outer surface of the guide unit 350.

To prevent the toner image from scattering due to vibration of the developing roller 125, the guide unit 350 is preferably mounted close to the predetermined nip A formed between the photosensitive medium 101 and the transfer belt 105. More preferably, the guide unit 350 is mounted between the intermediate transfer roller 304 and the nip roller 305.

As described above, a first transferring bias voltage is applied to the intermediate transfer roller 304 for transferring a toner image formed on the photosensitive medium 101 to the transfer belt 105. The toner image formed on the photosensitive medium 101 is transferred onto the transfer belt 105 by electrostatic force acting between the photosensitive medium 101 and the intermediate transfer roller 304. Therefore, transferring efficiency may be increased if the guide unit 350 mounted close to the intermediate transfer roller 304 is a conductor that blocks the electric field between the photosensitive medium 101 and the intermediate transfer roller 304. Therefore, the guide unit 350 preferably has an electrical resistance of 0.1-3 MΩ and a hardness of 26-38°.

The scattering (dispersing) of toner during transfer from the photosensitive medium 101 to the transfer belt 105 is reduced due to the shield effect of the guide unit 350. The supporting roller 302 faces a transferring roller 112. Also, in this exemplary embodiment, components included in the previous exemplary embodiment may be additionally included.

An image forming apparatus according to another exemplary embodiment of the present invention will now be described with reference to accompanying drawings. Again, in the drawings, components of the exemplary embodiment described below that are the same as in either of the exemplary embodiments described above are denoted by the same reference numerals.

Figure 12:
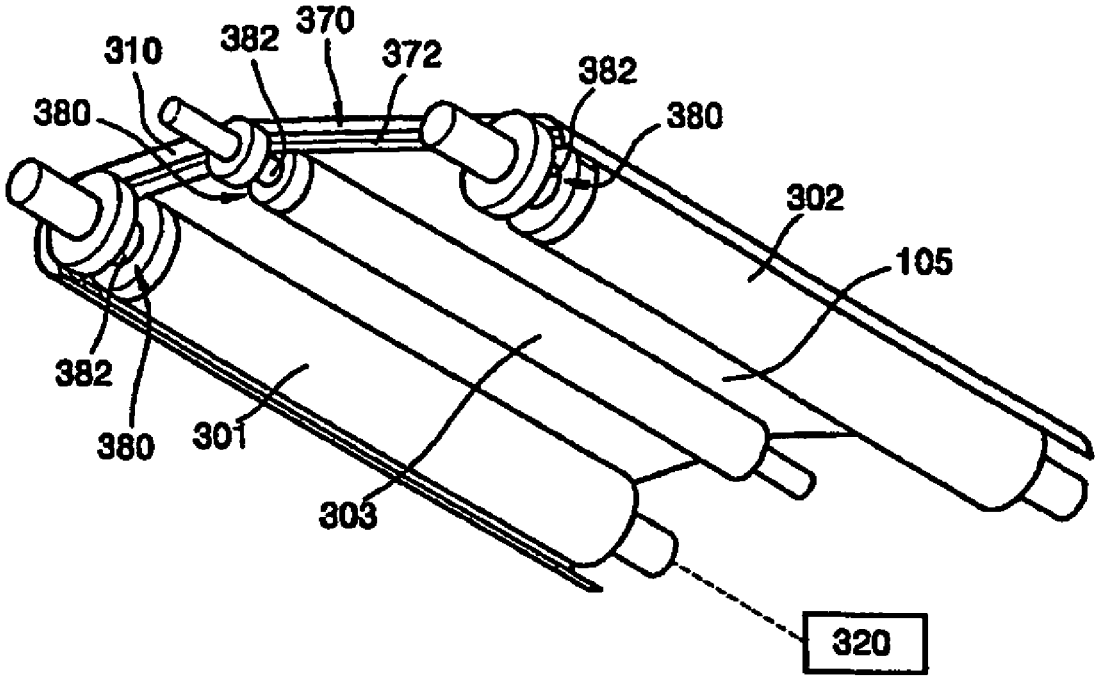
FIG. 12 is a perspective view of a portion of an intermediate transfer unit according to another exemplary embodiment of the present invention.
Figure 13:
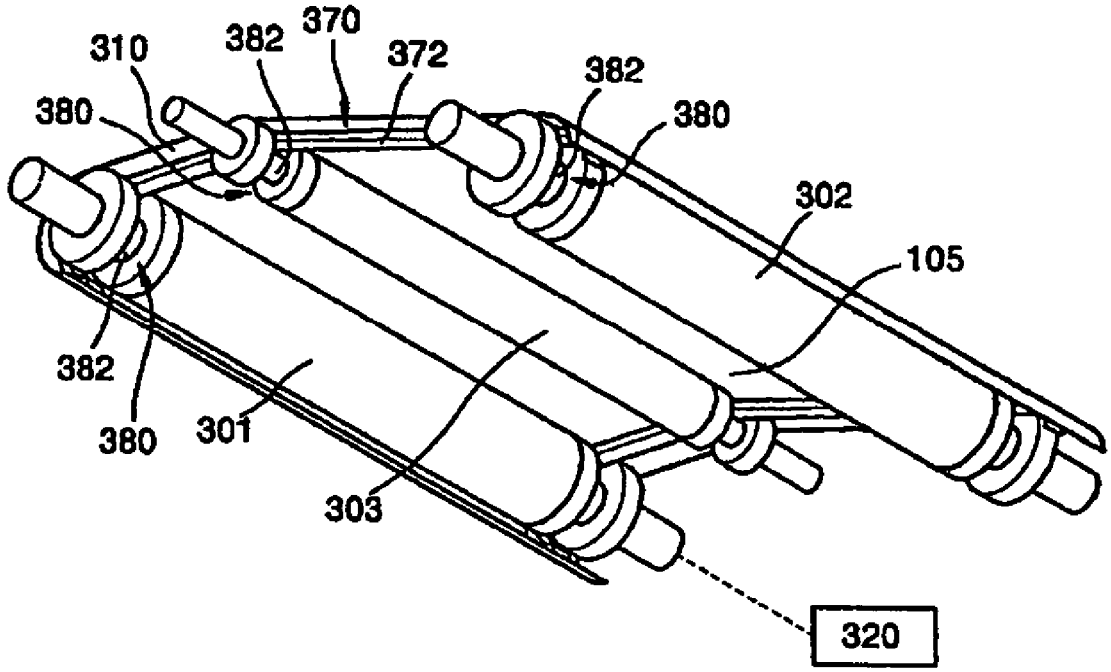
FIG. 13 is a perspective view of a portion of an intermediate transfer unit according to still another exemplary embodiment of the present invention.

FIG. 12 is a perspective view of a portion of an intermediate transfer unit according to another exemplary embodiment of the present invention. FIG. 13 is a perspective view of a portion of an intermediate transfer unit according to still another exemplary embodiment of the present invention.

The overall configuration and operation of the image forming apparatus, and the configuration and operation of the control unit that controls the stopping location of the transfer belt 105 are the same as described above.

Referring to FIG. 12, a bias preventing guide unit 370 is mounted on the protection unit 310, which is attached to the inner surface of the transfer belt 105. The bias preventing guide unit 370 is connected along the direction of motion of the transfer belt 105 and has a protruding part 372. The bias preventing guide unit 370 is mounted on an inner circumference of the transfer belt 105 by thermal or high-frequency bonding. The bias preventing guide unit 370 may be attached directly to the transfer belt 105. The protruding part 372 is inserted into a guide groove 382 provided in a guide pulley unit 380.

The guide pulley unit 380 is installed at least on the plurality of rollers 301, 302, 303, 304, and 305 (see FIG. 6). The guide pulley unit 380 includes the guide groove 382 that regulates the movement of the bias preventing guide unit 370 in a width direction on an outer surface of the guide pulley unit 380 contacting the transfer belt 105. The guide pulley unit 380 may be coupled to the axis of each of the rollers 301, 302, 303, 304 and 305 after manufacturing them separately, or may be formed as one body with each roller. The supporting rollers 301 and 302 preferably have a large diameter to prevent excessive bending of the transfer belt 105. The movement of the transfer belt 105 in a width direction is regulated by the guide groove 382 and wobbling of the transfer belt 105 is substantially prevented because the guide pulley unit 380 on which the guide groove 382 is attached is installed on at least one of the rollers 301, 302, 303, 304 and 305.

The bias preventing guide unit 370 and the guide pulley unit 380 are preferably mounted on a side of the transfer belt 105. Because the bias preventing guide unit 370 is mounted next to one edge of the transfer belt 105, the widthwise strength of the transfer belt 105 may be weaker than when the bias preventing guide unit 370 is mounted next to both edges, which increases flex characteristics of the transfer belt 105. Flex characteristics refer to required characteristics for forming a smooth curve on a circular arc, for example, a bending stress, a belt tension, and a cyclic loading.

The movement of the transfer belt 105 is preferably regulated by the guide pulley unit 380 to not substantially deviate from an outer surface of the guide pulley unit 380, because such deviation may cause damage and wobbling.

Additionally, the thickness of the bias preventing guide unit 370 is preferably greater than 0.8 mm and less than 1.2 mm so that the transfer belt 105 may be bent smoothly. When the thickness of the bias preventing guide unit 370 is less than 0.8 mm, accurate position regulation is difficult because the bias preventing guide unit 370 may easily cross over the guide groove 382 due to the shallow coupling depth with the guide groove 382. When the thickness of the bias preventing guide unit 370 is greater than 1.2 mm, smooth bending of the transfer belt 105 is difficult. The thickness of the bias preventing guide unit 370 refers to an average thickness within the deviation of manufacturing error. In an exemplary embodiment, components of the previous two embodiments may be additionally included.

The intermediate transfer unit depicted in FIG. 13 is substantially identical to the intermediate transfer unit depicted in FIG. 12 except that the bias preventing guide unit 370 and the guide pulley unit 380 of FIG. 13 are mounted on both sides of the transfer belt 105. Therefore, a detailed description thereof is omitted.

As described above, an image forming apparatus 100 according to the present invention substantially prevents wrinkles formed near the overlapping part 312 or the seam part 314 of the transfer belt 105.

Also, an image forming apparatus 100 according to exemplary embodiments of the present invention substantially prevents scattering, blurring and diffusion of an image due to vibration of the developing roller 125 by mounting an electrically conductive guide unit 350 at an inner surface of the transfer belt 105.

Also, an image forming apparatus 100 according to exemplary embodiments of the present invention substantially prevents the transfer belt 105 from wobbling or meandering and becoming damaged.

As described above, the image forming apparatus according to exemplary embodiments of the present invention has the following advantages. First, the loss of a portion of an image is substantially prevented by preventing wrinkles in the transfer belt, thereby improving image quality. Second, scattering, blurring and diffusion of an image, or the generation of cross bands, due to vibration of the developing roller is substantially prevented by mounting a guide unit at an inner surface of the transfer belt. Third, transferring efficiency is improved by mounting a guide unit having electric conductivity, which also improves image quality. Fourth, a small image forming apparatus that produces a high quality image may be manufactured by using a bias preventing guide unit and a guide groove that substantially prevents wobbling and meandering of the belt.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An image forming apparatus, comprising:

a transfer belt onto which a toner image formed on an outer surface of a photosensitive medium is transferred, the transfer belt traveling along a predetermined closed path while being supported by a plurality of rollers;

a protection unit that protects the transfer belt by being attached to at least one of an inner surface and an outer surface of a non-transferring region of the transfer belt; and a control unit that controls the transfer belt so that an overlapping part where the protection unit is attached to the transfer belt and a seam part where two ends of the transfer belt are connected stop at a predetermined location after printing.

2. The image forming apparatus of claim 1, wherein the control unit controls the transfer belt so that the overlapping part and the seam part stop between the plurality of rollers.

3. The image forming apparatus of claim 2, wherein a sensor unit senses a stopping location of the transfer belt to stop at the predetermined location.

4. The image forming apparatus of claim 3, wherein the protection unit is installed parallel to a direction of the transfer belt near both edges of the transfer belt.

5. The image forming apparatus of claim 4, wherein the protection unit is attached to the transfer belt with a bonding tension force of less than 500 gf/mm.

6. The image forming apparatus of claim 1, wherein the plurality of rollers include an intermediate transfer roller that transfers a toner image onto the transfer belt;

a supporting roller that supports the transfer belt; and a nip roller that maintains a predetermined nip between the photosensitive medium and the transfer belt.

7. The image forming apparatus of claim 6, wherein a guide unit is installed at the inner surface of the transfer belt facing the photosensitive medium to maintain the predetermined nip between the photosensitive medium and the transfer belt.

8. The image forming apparatus of claim 7, wherein the guide unit is mounted close to the predetermined nip.

9. The image forming apparatus of claim 8, wherein the guide unit has electrical conductivity.

10. The image forming apparatus of claim 9, wherein the guide unit has an electrical resistance of 0.1-3 MΩ and a hardness of 26-38°.

11. The image forming apparatus of claim 10, wherein the guide unit is mounted between the intermediate transfer roller and the nip roller.

12. The image forming apparatus of claim 6, wherein the transfer belt is made of polyimide.

13. The image forming apparatus of claim 12, wherein the transfer belt has a thickness of approximately 75 μm.

14. The image forming apparatus of claim 1, wherein a bias preventing guide unit that extends in the direction of motion of the transfer belt and is mounted on the protection unit attached to an inner surface of the transfer belt; and a guide pulley unit that has a guide groove that regulates the movement of the bias preventing guide unit in a width direction, and is mounted on an outer surface of at least one of the plurality of rollers.

15. The image forming apparatus of claim 14, wherein the bias preventing guide unit and the guide pulley unit are mounted at one side of the transfer belt.

16. The image forming apparatus of claim 15, wherein the transfer belt is regulated by the guide pulley unit to substantially prevent deviation from an outer surface of the guide pulley unit.

17. The image forming apparatus of claim 16, wherein the bias preventing guide unit has a thickness greater than 0.8 mm and less than 1.2 mm.

18. The image forming apparatus of claim 14, wherein the control unit controls the transfer belt so that the overlapping part and the seam part are located at a span between the plurality of rollers.

19. The image forming apparatus of claim 14, wherein an intermediate transfer roller transfers a toner image onto the transfer belt;

a supporting roller supports the transfer belt; and a nip roller maintains a predetermined nip between the photosensitive medium and the transfer belt.

20. The image forming apparatus of claim 19, wherein a guide unit is installed at the inner surface of the transfer belt facing the photosensitive medium to maintain the predetermined nip between the photosensitive medium and the transfer belt.

21. An image forming apparatus, comprising:

a transfer belt onto which a toner image formed on an outer surface of a photosensitive medium is transferred, the transfer belt traveling along a predetermined closed path while being supported by a plurality of rollers;

two rollers of the plurality of rollers disposed at an inner surface of the transfer belt so that a nip between the photosensitive medium and the transfer belt is maintained; and a guide unit disposed at the inner surface of the transfer belt facing the photosensitive medium to prevent vibration of the nip during a transfer operation, wherein a transferring bias voltage is applied to one of the two rollers to transfer the toner image from the photosensitive medium onto the transfer belt, and the guide unit is an electrical conductor that blocks an electric field between the photosensitive medium and the one roller to which the transferring bias voltage is applied, thereby facilitating the image transfer.

22. The image forming apparatus of claim 21, wherein the guide unit is mounted close to the nip.

23. The image forming apparatus of claim 21, wherein the guide unit is mounted between the two rollers.

* * * * *